US009604271B2

(12) United States Patent
Pace et al.

(10) Patent No.: US 9,604,271 B2
(45) Date of Patent: Mar. 28, 2017

(54) PIPE BENDING MACHINE WITH REAR CALENDER AND ITS RESPECTIVE CALENDERING PROCEDURE

(71) Applicant: CRIPPA S.p.A., Arosio (IT)

(72) Inventors: Alessandro Pace, Arosio (IT); Claudio Bargna, Arosio (IT)

(73) Assignee: CRIPPA S.p.A., Arosio (CO) (IT)

( * ) Notice: Subject to any disclaimer, the term of this patent is extended or adjusted under 35 U.S.C. 154(b) by 220 days.

(21) Appl. No.: 14/329,299

(22) Filed: Jul. 11, 2014

(65) Prior Publication Data

US 2015/0027193 A1 Jan. 29, 2015

(30) Foreign Application Priority Data

Jul. 29, 2013 (IT) ..... MI2013A1272

(51) Int. Cl.

| | |
|---|---|
| ***B21D 7/04*** | (2006.01) |
| ***B21D 7/02*** | (2006.01) |
| ***B21D 7/024*** | (2006.01) |
| ***B21D 37/14*** | (2006.01) |
| ***B21D 7/08*** | (2006.01) |

(52) U.S. Cl.

CPC ..... *B21D 7/04* (2013.01); *B21D 7/02* (2013.01); *B21D 7/08* (2013.01); *B21D 7/024* (2013.01); *B21D 37/14* (2013.01)

(58) Field of Classification Search

CPC ..... B21D 37/14; B21D 7/024; B21D 7/02; B21D 7/022

See application file for complete search history.

(56) References Cited

U.S. PATENT DOCUMENTS

| | | | | |
|---|---|---|---|---|
| 4,391,116 A * | 7/1983 | Yogo | ..... | B21D 7/08 72/166 |
| 7,134,310 B2 * | 11/2006 | Hu | ..... | B21D 7/024 72/217 |
| 8,359,896 B2 * | 1/2013 | Wolf | ..... | B21D 7/02 72/149 |

* cited by examiner

*Primary Examiner* — Peter DungBa Vo
*Assistant Examiner* — John S Lowe
(74) *Attorney, Agent, or Firm* — Greer Burns & Crain, Ltd.

(57) ABSTRACT

A machine to bend pipes that includes: a plate that is configured and arranged to move along an X-axis; a bending head connected to the plate, where the bending head is capable of moving along a Z-axis and is equipped with at least one bending arm and at least one bending die; and at least one calendering jig, which is located at a position that is before the bending die, with respect to a feeding direction of the pipe. The calendering jig includes at least two first rolls used to lock the pipe and at least one second roll that is configured and arranged for determining the calendering radius of the pipe, wherein the at least one second roll is anchored to the plate. The bending head is configured and arranged to move in the Z direction with respect to both the plate and the second roll.

5 Claims, 2 Drawing Sheets

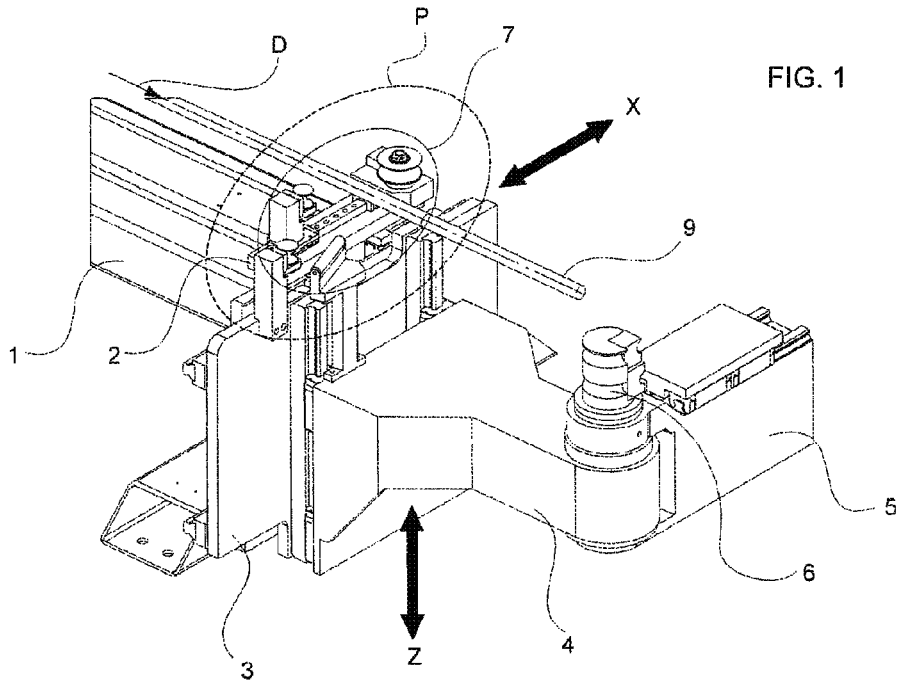
FIG. 1
FIG. 2
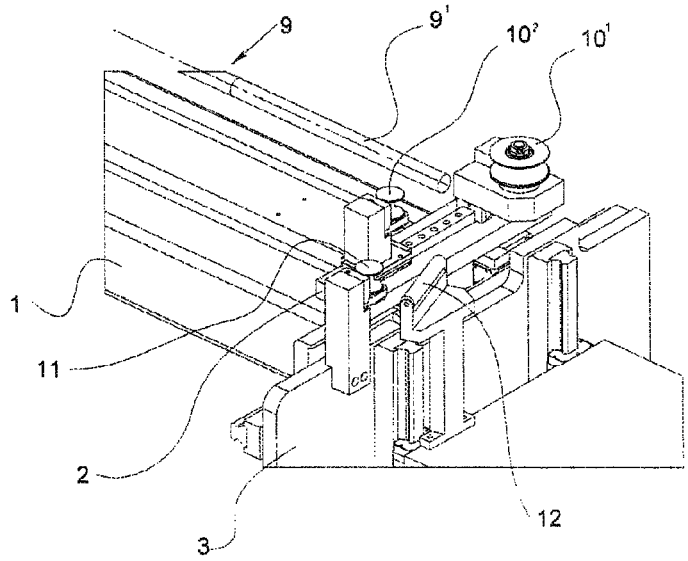

PIPE BENDING MACHINE WITH REAR CALENDER AND ITS RESPECTIVE CALENDERING PROCEDURE

FIELD OF THE INVENTION

The present invention relates to a machine to bend pipes and the like, equipped with at least one bending die working table more than the machines used to bend pipes and the like known so far.

BACKGROUND OF THE INVENTION

In the machines used to bend pipes and the like, the calendaring operation is carried out on a table of the bending die specifically dedicated to this purpose. In the machines used to bend pipes and the like known so far, the calendering table is positioned alternatively as a first working table or as a last working table of the machine. A drawback in the calendering operation performed in the machines used to bend pipes and the like known so far consists in that it limits the possibility of working the pipe or the like while it is wound.

BRIEF SUMMARY OF THE INVENTION

The present invention advantageously solves the drawbacks of the machines used to bend pipes and the like currently known, by adding at least one working table of the machine's bending die. This advantage is obtained by means of a machine to bend pipes and the like comprising a bed equipped, at one end, with a plate capable of moving along the X-axis parallel to the table on which the bed is located. The bending head of the machine used to bend pipes and the like is connected to this plate in such a way as to be able to move along the Z-axis orthogonal to the table on which said bed is located. Said bending head is provided with at least one bending arm, at least one bending die, at least one calendering jig, and means to feed the pipe to be worked. The calendering jig is located before the bending die, as referred the feeding direction of the pipe to be worked toward the bending die which is exerted to said pipe by the feeding means of the bending head.

Said calendering jig comprises at least one pair of first rolls and at least one second roll. In a preferred embodiment of this invention, the pair of first rolls used to lock the pipe to be worked are opposed to each other and lie on the end of the bed next to the bending die, whereas the second roll is anchored to the mentioned plate, preferably anchored to the upper portion of said plate. Said second roll determines the calendering radius of the pipe in any embodiments.

The calendering jig also comprises at least one device suitable for supporting the pipe to be worked and also suitable for generating and controlling the winding pitch of said pipe, said device being anchored to the bending head.

The procedure to calender the pipe to be worked in a machine to bend pipes and the like according to the present invention comprises the following steps:

- a first step, in which the portion of the pipe to be calendered positioned in correspondence with the pair of first rolls;
- a second step, in which the portion of the pipe to be calendered is locked by said pair of first rolls;
- a third step, in which the mentioned plate of the bed, as already said before, capable of moving along the X-axis, is moved, so as to position the second roll in such a position as to determine the calendering radius according to the operating process set by the operator;
- a fourth step, in which the portion of the pipe to be calendered is fed towards and beyond the second roll.

In said fourth step, the second roll preferably modifies its own position, by varying the calendering radius of the pipe and, even more preferably, the pipe undergoes a further rotation according to the operating process set by the operator.

The procedure for calendering the pipe according to the present invention comprises a further fifth step, in which the pipe supporting device, anchored to the bending head, is made move along the Z-axis so as to support, generate and control the pipe's winding pitch.

BRIEF DESCRIPTION OF THE SEVERAL VIEWS OF THE DRAWINGS

FIG. 1 shows a perspective view of the machine used to bend pipes and the like according to the present invention.

FIG. 2 shows a perspective view of the calendering jig.

DETAILED DESCRIPTION OF THE INVENTION

Figure 3:
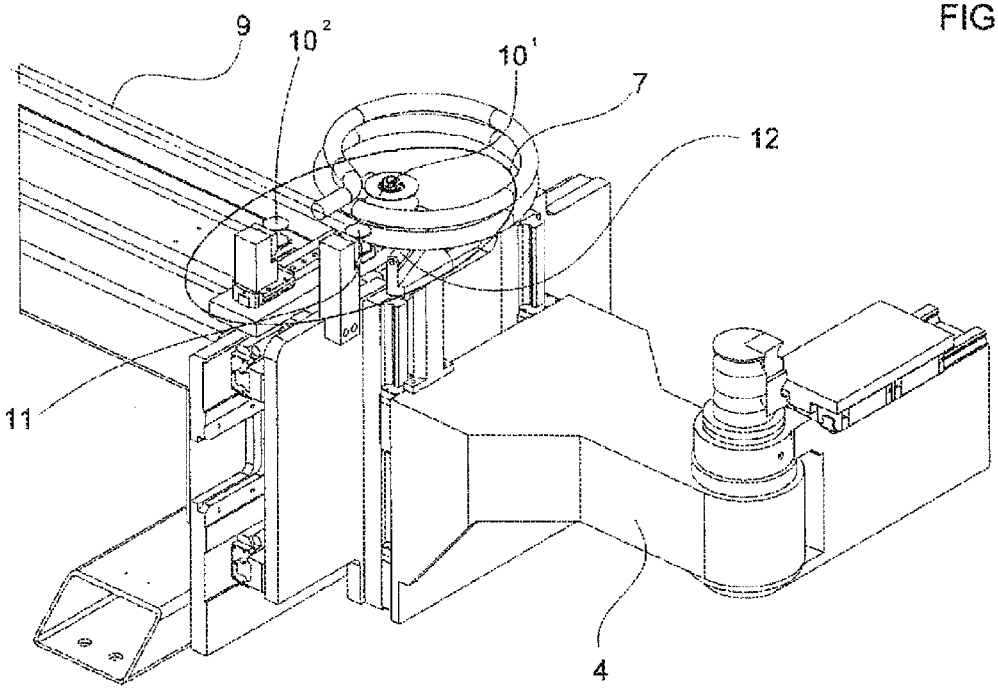
FIG. 3 shows a perspective view of the machine according to this invention, with a special emphasis dedicated to the calendering jig to support, generate, and control the pipe's winding pitch.

FIG. 1 shows a perspective view of the machine to bend pipes and the like comprising a bed (1) having, at one of its ends (2), a plate (3) capable of moving along the X-axis parallel to the table on which the bed (1) is located, a bending head (4) connected to the plate (3), said bending head (4) being capable of moving along the Z-axis orthogonal to the table on which the bed (1) is located, equipped with a bending arm (5), a bending die (6), a calendering jig (7), and means, not shown in the figures, to feed the pipe (9). The calendering jig (7) has a position (P) located before the bending die (6) as moving in the feeding direction (D) of the pipe (9).

FIG. 2 shows a perspective view of the calendering jig (7), comprising at least two first rolls ($\mathbf{10}^1$ and $\mathbf{10}^2$) used to lock the pipe (9), opposed to each other and lying at the end (2) of the bed (1), a second roll (11) determining the calendering radius of the pipe (9), anchored to the upper portion of said plate (3).

FIG. 3 shows a perspective view of the calendering jig (7) comprising a device (12) suitable for supporting the pipe (9) and also suitable for generating and controlling the winding pitch of the pipe (9), said device (12) being anchored to the bending head (4).

The invention claimed is:

1. A machine to bend pipes comprising:

a bed;

a plate, positioned at one end of said bed, said plate being configured and arranged to move along an X-axis that is parallel to a surface on which the bed is located;

a bending head connected to the plate, said bending head being configured and arranged to move along a Z-axis that is orthogonal to the surface on which the bed is located, said bending head being equipped with at least one bending arm and at least one bending die; and at least one calendering jig; and wherein said calendering jig is located at a position that is before the bending die, with respect to a feeding direction of the pipe, wherein the calendering jig comprises at least two first rolls used to lock the pipe, wherein the two first rolls are opposed to each other and positioned at the end of the bed, and a second roll that is configured and arranged for determining the calendering radius of the pipe, wherein said second roll is anchored to the upper portion of the plate, and wherein said bending head is configured and arranged to move-independently in the Z direction with respect to both said plate and said second roll.

2. A machine to bend pipes and the like according to claim 1, wherein the calendering jig comprises at least one device configured and arranged for supporting the pipe and configured and arranged for generating and controlling a winding pitch of the pipe, wherein said device is anchored to the bending head.

3. A procedure to calender pipe by using a machine to bend the pipe, wherein the machine comprises: a bed; a plate, positioned at one end of said bed, said plate being configured and arranged to move along an X-axis that is parallel to a surface on which the bed is located; a bending head connected to the plate, said bending head being capable of moving along a Z-axis that is orthogonal to the surface on which the bed is located, said bending head being equipped with at least one bending arm and at least one bending die; and at least one calendering jig; and wherein said calendering jig is located at a position that is before the bending die, with respect to a feeding direction of the pipe, wherein the calendering jig comprises at least two first rolls used to lock the pipe, wherein the two first rolls are opposed to each other and positioned at the end of the bed, and a second roll that is configured and arranged for determining the calendering radius of the pipe, wherein said second roll is anchored to the upper portion of the plate, and wherein said bending head is configured and arranged to move independently in the Z direction with respect to both said plate and said second roll, the procedure comprising the following steps:

a first step, in which a portion of the pipe to be calendered is positioned in correspondence with the first rolls;

a second step, in which the portion is locked by the first rolls;

a third step, in which the plate is moved along the X-axis, so as to position the second roll in such a position as to determine the calendering radius according to an operating process set by an operator;

a fourth step, in which the portion is fed towards and beyond the second roll, and a fifth step of moving the bending head, which includes a device anchored thereto, which is configured and arranged for supporting the pipe, along the Z-axis, thereby supporting the pipe and controlling the winding pitch of the pipe.

4. The procedure to calender the pipe according to claim 3, wherein, during the fourth step, the second roll modifies its position by varying the calendering radius of the pipe.

5. The procedure to calender the pipe according to claim 4, wherein the fourth step also comprises rotation of the pipe according to the operating process set by the operator.

* * * * *